US006243953B1

(12) United States Patent
Huang

(10) Patent No.: US 6,243,953 B1
(45) Date of Patent: Jun. 12, 2001

(54) UTILITY KNIFE

(76) Inventor: Yin Han Huang, No. 108-24, Chong Chin Road, Bei Tun Chu, Taichung (TW), 406

( * ) Notice: Subject to any disclaimer, the term of this patent is extended or adjusted under 35 U.S.C. 154(b) by 0 days.

(21) Appl. No.: 09/493,291

(22) Filed: Jan. 28, 2000

(51) Int. Cl.[7] ..... B26B 1/08

(52) U.S. Cl. ..... 30/162; 30/335

(58) Field of Search ..... 30/162, 125, 335, 30/336

(56) References Cited

U.S. PATENT DOCUMENTS 5,121,544 * 6/1992 Gilbert ..... 30/162

* cited by examiner

*Primary Examiner*—Douglas D. Watts

(57) ABSTRACT

A utility knife includes a pair of housing members having a front portion detachably secured together with a catch engagement. One housing member has a latch portion disposed in the rear portion, and a knob is slidably engaged through the other housing member and has a latch engaged with the latch portion for securing the rear portions of the housing members together. A spring may bias the latch of the knob to engage with the latch portion. The other housing has one or more swellings for securing the knob to the other housing member at the required position.

7 Claims, 3 Drawing Sheets

UTILITY KNIFE

BACKGROUND OF THE INVENTION

1. Field of the Invention

The present invention relates to a knife, and more particularly to a utility knife having a simplified configuration.

2. Description of the Prior Art

Typical utility knives comprise a housing having two housing members to be secured together, and a complicated configuration is required and provided for securing the two housing members together.

The present invention has arisen to mitigate and/or obviate the afore-described disadvantages of the conventional utility knives.

SUMMARY OF THE INVENTION

The primary objective of the present invention is to provide a utilitny knife having a simplified configuration for securing the housing members together.

In accordance with one aspect of the invention, there is provided a utility knife comprising a pair of housing members each including a front portion and a rear portion, a first of the housing members including a latch portion provided therein a second of the housing members including a groove formed therein, a blade received in the front portion of the housing members, catch means for securing the front portions of the housing members together, and a knob slidably engaged in the groove of the second housing member and including a latch for engaging with the latch portion of the first housing member and for securing the rear portions of the housing members together when the latch is moved to engage with the latch portion of the first housing member by the knob.

The latch portion of the first housing member includes an opening formed therein for receiving the latch of the knob. A slide coupling means is further provided for slidably securing the knob to the second housing member and includes a pair of slots formed in the rear portion of the second housing member, and includes a pair of hooks extended from the knob and slidably engaged through the slots of the second housing member and hooked with the second housing member. The knob includes a block extended therefrom, the latch is extended from the block of the knob.

A spring biasing device is further provided for biasing the latch of the knob to engage with the latch portion of the first housing member. The second housing includes A stop provided therein, the knob includes a projection extended therefrom, the biasing means includes a spring engaged between the stop and the projection of the knob.

A force-fitted engaging device is further provided for securing the knob to the second housing member and includes at least one swelling extended from the second housing member for engaging with the knob and for securing the knob to the second housing member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
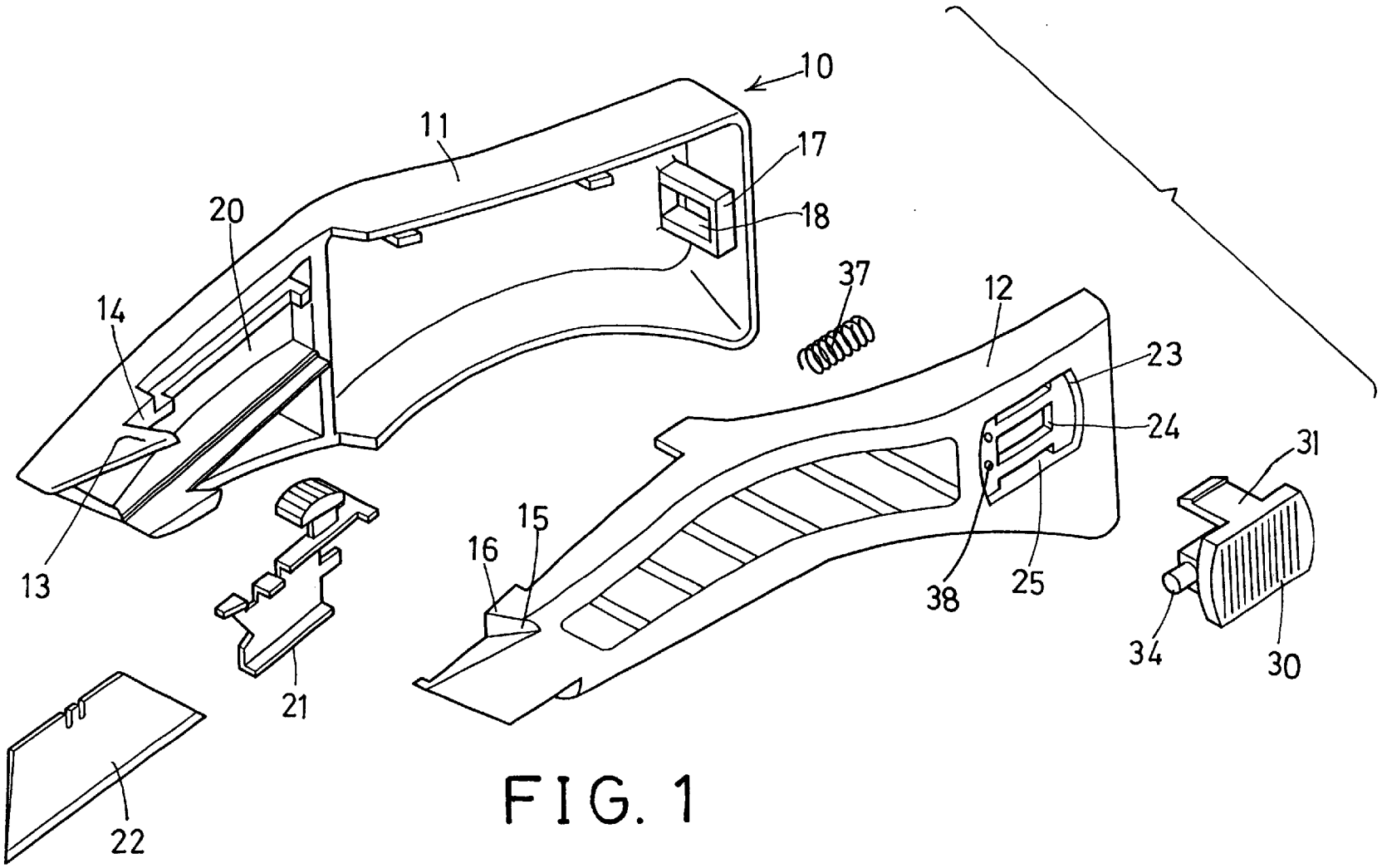
FIG. 1 an exploded view of a utility knife in accordance with the present invention.
Figure 2:
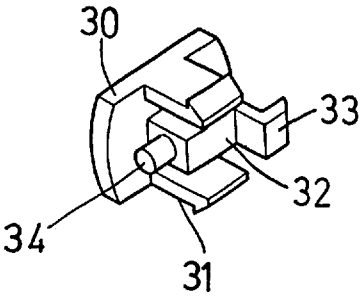
FIG. 2 is a perspective view of a knob for the utility knife as seen from the other direction different from that shown in FIG. 1.

Referring to the drawings, and initially to FIGS. 1–5, a utility knife in accordance with the present invention comprises a housing 10 including two housing members 11, 12 to be secured together. The housing member 11 includes a catch 13 and a cavity 14 formed in the front portion thereof for engaging with a recess 15 and a protrusion 16 that are formed in the front portion of the other housing member 12 and for securing together. The front portion of the housing 10 or of the housing members 11, 12 includes a channel 20 formed therein for slidably receiving a blade 22 or a blade holder 21 which may be used for supporting a blade 22 therein and which may be used for moving the blade 22 inward and outward of the housing 10. The housings member 11 includes a latch portion 17 provided in the rear portion thereof and having an opening 18 formed therein. The other housing member 12 includes a depression 23 formed in the outer and rear portion thereof and includes a groove 24 and a pair of slots 25 formed therein and communicating with the depression 23 thereof.

A knob 30 is partially received in the depression 23 of the housing member 12 and includes a pair of hooks 31 slidably engaged through the slots 25 of the housing member 12 and hooked to the housing member 12 for slidably securing the knob 30 to the housing member 12 and for allowing the knob 30 to be slided forward and rearward relative to the housing member 12. The knob 30 includes a block 32 extended therefrom and slidably engaged in the groove 24 of the housing member 12 for guiding the knob 30 to move forward and rearward relative to the housing member 12 and for limiting the movement of the knob 30 relative to the housing member 12. The knob 30 includes a latch member 33 extended therefrom, preferably extended from the block 32 for engaging with the latch portion 17 of the housing member 11, and for securing the rear portions of the housing members 11, 12 together. The knob 30 includes a projection 34 extended therefrom for engaging with one end of a spring 37 which has the other end engaged with a stop 27 of the housing member 12 (FIGS. 5, 6), and for forcing the latch member 33 to engage with the latch portion 17 of the housing member 11.

The housing member 12 may include one or more swellings 38 extended inward of the depression 23 of the housing member 12 (FIGS. 4–6) for engaging with the knob 30 and for securing the knob 30 to the housing member 12 and for maintaining the engagement of the latch member 33 with the latch portion 17, particularly the opening 18 of the latch portion 17 of the housing member 11. It is to be noted that, without the swellings 38 and the spring 37, the latch member 33 may also be maintained at the engagement with the opening 18 of the latch portion 17 of the housing member 11 by a force-fitted engagement or the like. The spring 37 is provided for forcing and for stably maintaining the engagement of the latch member 33 with the opening is of the latch portion 17 of the housing member 11.

Figure 5:
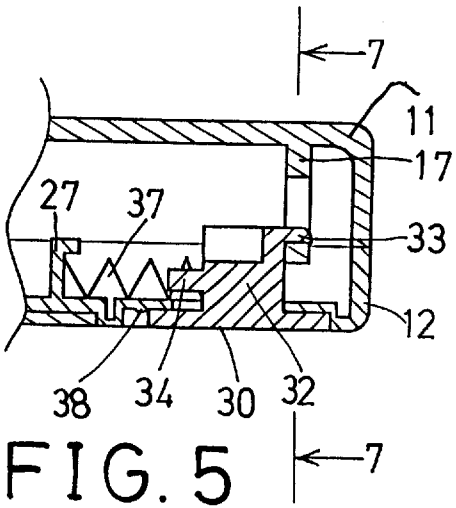
FIG. 5 is a cross sectional view taken along lines 5—5 of FIG. 7.
Figure 3:
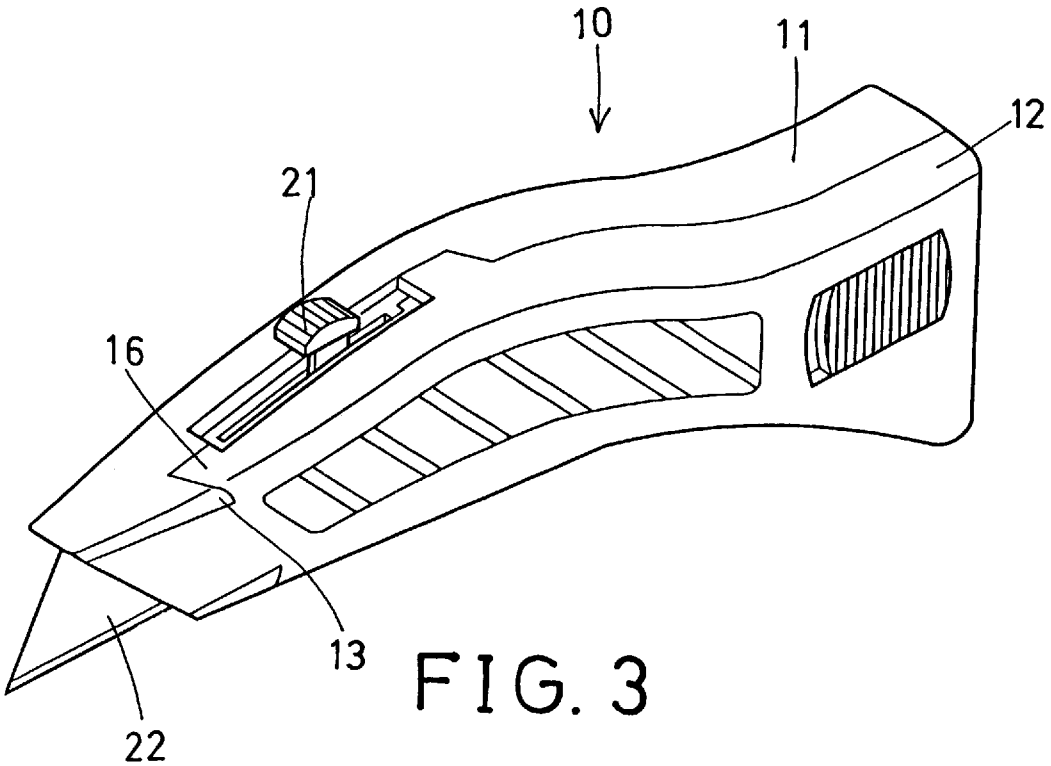
FIG. 3 is a perspective view of the utility knife.
Figure 7:
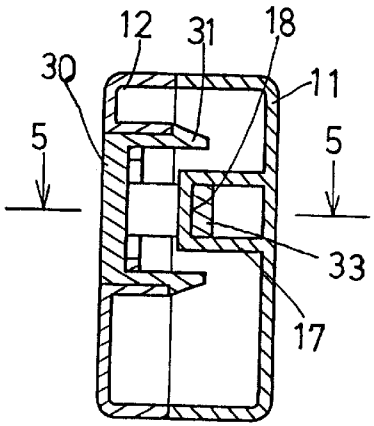
FIG. 7 is a cross sectional view taken along lines 7—7 of FIG. 5.
Figure 4:
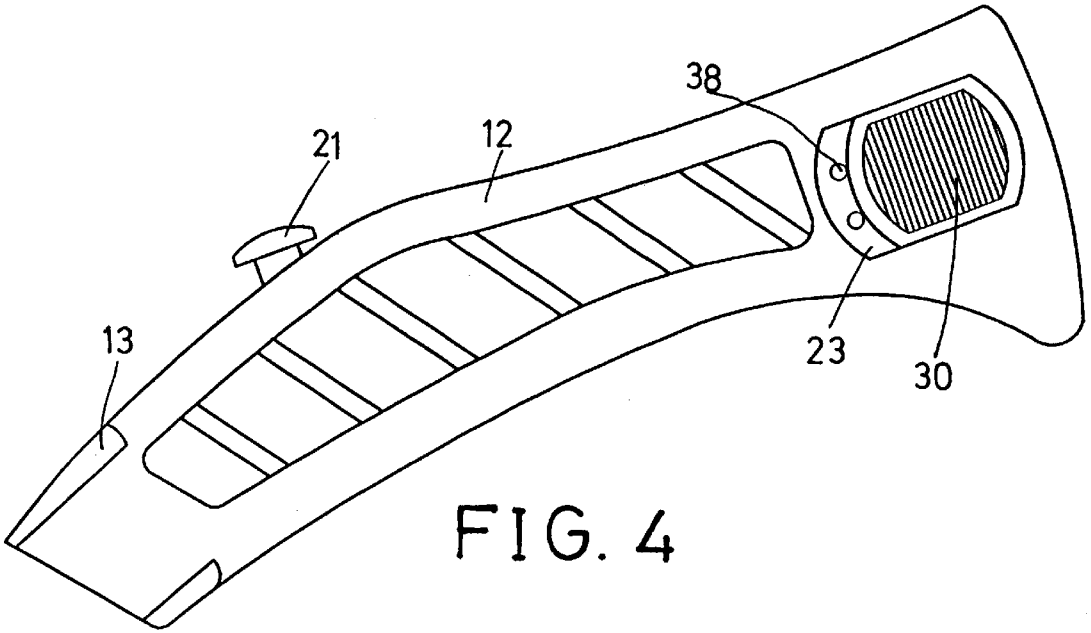
FIG. 4 is a plane view of the utility knife.
Figure 6:
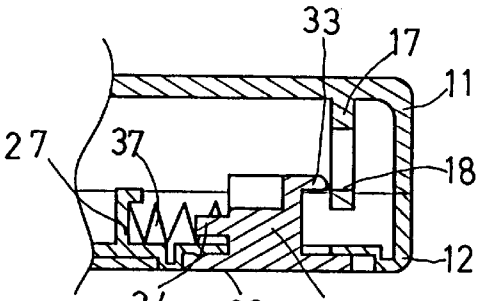
FIG. 6 is a cross sectional view similar to FIG. 5, illustrating the operation of the utility knife.

In operation, as shown in FIGS. 5–7, the latch member 33 of the knob 30 may be moved to engage with the latch portion 17 of the housing member 11 for securing the rear portions of the housing members 11, 12 together. The provision of the spring 37 may further stably forcing the latch member 33 to engage with the latch portion 17 of the housing member 11 and to secure the rear portions of the housing members 11, 12 together. The engagement of the knob 30 with the swelling(s) 38 of the housing member 12 may further securing the knob 30 to the housing member 12 at the required position.

Accordingly, the utility knife in accordance with the present invention includes a simplified configuration for securing the housing members together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A utility knife comprising:

a pair of housing members each including a front portion and a rear portion, a first of said housing members including a latch portion provided therein, a second of said housing members including a groove formed therein, a blade received in said front portion of said housing members, catch means for securing said front portions of said housing members together, a knob slidably engaged in said groove of said second housing member and including a latch for engaging with said latch portion of said first housing member and for securing said rear portions of said housing members together when said latch is moved to engage with said latch portion of said first housing member by said knob, and means for slidably securing said knob to said second housing member, said slidably securing means including a pair of slots formed in said rear portion of said second housing member and including a pair of hooks extended from said knob and slidably engaged through said slots of said second housing member and hooked with said second housing member.

2. The utility knife according to claim 1, wherein said latch portion of said first housing member includes an opening formed therein for receiving said latch of said knob.

3. The utility knife according to claim 1, wherein said knob includes a block extended therefrom, said latch is extended from said block of said knob.

4. The utility knife according to claim 1 further comprising means for biasing said latch of said knob to engage with said latch portion of said first housing member.

5. A utility knife comprising:

a pair of housing members each including a front portion and a rear portion, a first of said housing members including a latch portion provided therein, a second of said housing members including a groove formed therein, said second housing including a stop provided therein, a blade received in said front portion of said housing members, catch mean s for securing said front portions of said housing members together, a knob slidably engaged in said groove of said second housing member and including a latch for engaging with said latch portion of said first housing member and for securing said rear portions of said housing members together when said latch is moved to engage with said latch portion of said first housing member by said knob, said knob including a projection extended therefrom, and means for biasing said latch of said knob to engage with said latch portion of said first housing member, said biasing means including a spring engaged between said stop and said projection of said knob.

6. The utility knife according to claim 1 further comprising means for securing said knob to said second a housing member.

7. A utility knife comprising:

a pair of housing members each including a front portion and a rear portion, a first of said housing members including a latch portion provided therein, a second of said housing members including a groove formed therein, a blade received in said front portion of said housing members, catch means for securing said front portions of said housing members together, a knob slidably engaged in said groove of said second housing member and including a latch for engaging with said latch portion of said first housing member and for securing said rear portions of said housing members together when said latch is moved to engage with said latch portion of said first housing member by said knob, and means for securing said knob to said second housing member, said knob securing means including at least one swelling extended from said second housing member for engaging with said knob and for securing said knob to said second housing member.

* * * * *